US008648238B1

(12) United States Patent
Trabits

(10) Patent No.: US 8,648,238 B1
(45) Date of Patent: Feb. 11, 2014

(54) STRING INSTRUMENT

(76) Inventor: James A Trabits, Daytona Beach, FL (US)

( * ) Notice: Subject to any disclaimer, the term of this patent is extended or adjusted under 35 U.S.C. 154(b) by 0 days.

(21) Appl. No.: 13/565,107

(22) Filed: Aug. 2, 2012

(51) Int. Cl.
*G10D 3/04* (2006.01)

(52) U.S. Cl.
USPC ..... 84/298

(58) Field of Classification Search
None
See application file for complete search history.

(56) References Cited

U.S. PATENT DOCUMENTS

| | | | | | |
|---|---|---|---|---|---|
| 519,416 | A * | 5/1894 | Turner | 84/299 |
| 539,789 | A * | 5/1895 | Boyd et al. | 84/298 |
| 2,025,875 | A * | 12/1935 | Loar | 84/726 |
| 2,046,331 | A * | 7/1936 | Loar | 84/307 |
| 4,026,181 | A * | 5/1977 | Barcus et al. | 84/291 |
| 4,253,371 | A * | 3/1981 | Guice | 84/267 |
| 4,793,233 | A * | 12/1988 | Olthoff | 84/299 |
| 5,260,505 | A * | 11/1993 | Kendall | 84/298 |
| 5,503,054 | A * | 4/1996 | Ellsworth et al. | 84/307 |
| 5,549,027 | A * | 8/1996 | Steinberger et al. | 84/297 R |
| 5,661,252 | A * | 8/1997 | Krawczak | 84/291 |
| 5,679,910 | A * | 10/1997 | Steinberger et al. | 84/291 |
| 5,922,979 | A * | 7/1999 | Yui | 84/291 |
| 7,411,121 | B2 * | 8/2008 | McGill | 84/291 |
| 7,462,767 | B1 * | 12/2008 | Swift | 84/291 |
| 8,138,403 | B1 * | 3/2012 | Kemp | 84/291 |
| 8,203,059 | B2 * | 6/2012 | Miloslavsky | 84/291 |
| 2005/0076764 | A1 * | 4/2005 | Davis | 84/299 |
| 2008/0190263 | A1 * | 8/2008 | Drew | 84/291 |
| 2011/0005366 | A1 * | 1/2011 | Gillett | 84/298 |

* cited by examiner

*Primary Examiner* — Robert W Horn
(74) *Attorney, Agent, or Firm* — Daniel Law Offices, P.A.; Jason T. Daniel, Esq.

(57) ABSTRACT

A stringed musical instrument is disclosed for preferentially adjusting sound harmonics. The stringed musical instrument includes a body having a soundboard with a soundhole formed through the soundboard, a bridge, including a string support saddle mounted thereon, for supporting a plurality of instrument strings, a vertical member disposed within the body attached to the bridge through apertures in the soundboard, wherein the vertical member is further attached to an flexible member configured to affect rotation of the bridge, and a safety stop component disposed with in the body and configured to restrict movement of the vertical member. The soundboard is attached to the body via a side binding and unattached to internal support members within the body.

20 Claims, 13 Drawing Sheets

STRING INSTRUMENT

TECHNICAL FIELD

This disclosure relates generally to a stringed instrument, and more particularly to a guitar.

BACKGROUND

The statements in this section merely provide background information related to the present disclosure and may not constitute prior art.

Typical acoustic guitars have a neck attached to one end of a hollow wooden body. Nylon or steel strings are strung under tension between the top of the neck and an opposite end of the body. The strings gradually range from thick bass strings toward the bottom of the guitar to thin treble strings toward the top of the guitar on a right-handed guitar, opposite on a left-handed guitar. String tension may be dependent upon string material and mass. The body is comprised of a front soundboard connected to a backboard by a curved side wall. The soundboard is generally pierced by a sound hole that is traditionally centered, but known guitar embodiments may include sound holes disposed anywhere on the soundboard. The soundboard is made relatively thin to vibrate in response to the vibrations of the strings to amplify the sound.

The soundboard is typically reinforced by internal braces attached to its internal guitar body including internal sides to provide structural reinforcement and dimensional stability under the tension of the strings. Although the braces must be stiff enough to provide support, they must still allow the soundboard to vibrate. The most common braces are each attached to the soundboard along its entire length, particularly to thin soundboards. Typical known bracing includes composite materials, wood or synthetic materials that are larger in cross section or more in number as the soundboard is thinned to make up for structural integrity lost due to thinning of soundboard. Known soundboard embodiment are built with either auxiliary bracing attached by glue or other means directly to the soundboard itself or by use of alternate soundboard material construction using composites, honeycomb reinforcement, laminated construction or extra thick wooden soundboards to prevent failure of the soundboard by countering the physical forces introduced by attached strings. Forces acting upon the soundboard by attached strings include tension, compression, shear and moment.

Moment forces, particularly, require stronger bracing, having greater mass than otherwise would be required if compression, shear and tension forces would be the only forces required to brace. Therefore, it would be advantageous to construct a stringed instrument that decreases moment forces acting upon the guitar soundboard, thereby decreasing tone dampening and undesirable harmonic distortion effects, and increasing volume output.

During the life of an instrument, environmental conditions such as humidity changes can cause dimensional changes in wooden bracing, the soundboard and/or the instrument as a whole. Additionally, changes in a weight or radius of instrument strings can affect position of the strings over the neck and therefore "playability." For example, higher tension strings will result in the bridge and saddle rotating forward—lowering the effective height of the strings over the neck and directly affecting the overall string length thus affecting instrument playability and tune. Reducing tension of a traditional truss rod within the neck to compensate for the rotation of the bridge in order to raise the strings to the correct height above the fingerboard surface under such condition can result in a reduction to overall string length due to increased neck bow requiring lowering of the string tension to correct the open string note. The change in "scale length" i.e., a distance between saddle and nut, will cause a change in the non-adjustable fretted strings to saddle lengths causing and compounding intonation issues.

Therefore, to maintain a preferably or consistent sound output, adjustment to the soundboard height via adjustment of an underside height adjuster assembly and an assembly to control bridge rotation is desirable. An assembly configured to adjust string height over the fingerboard and control bridge rotation between the bridge saddle and neck nut enables a user to control "action" or instrument "playability," and precision control over production of a desired note. These controls in combination with the traditional truss rod adjustment offer more parametric parameters of control over the instrument itself than would otherwise be afforded to the musician and his individual preferences while allowing faithful sound production.

Further, in guitar and string instrument production, initial string height over the fingerboard and proper angle of strings is achieved through a laborious process of fitting the neck to the body at a correct angle to the installed bridge so that string alignment and string height over the fingerboard are within specification. Fitting typically includes removing, i.e., carving, wood from the neck heel and mating surface to achieve the correct angle and height of the neck relative to the bridge or saddle. In some guitar embodiment, shims are placed between the neck-body interface and the neck heel-body in order to achieve the proper angle and height. Proper neck angle often takes a many iterations of fitting to achieve the desired results and can be labor intensive.

Therefore, it would be advantageous to set the neck angle and bridge close to desirable settings prior to installing strings. Subsequent to string installation, the initial settings may then be adjusted without a neck reset or other laborious process such as de-stringing and resetting the necks shims, thereby increasing production efficiency and more advantageously accommodating differences in soundboard wood properties.

SUMMARY

A stringed musical instrument is disclosed for preferentially adjusting sound harmonics. The stringed musical instrument includes a body having a soundboard with a soundhole formed through the soundboard, a bridge, including a string support saddle mounted thereon, for supporting a plurality of instrument strings, a vertical member disposed within the body attached to the bridge through apertures in the soundboard, wherein the vertical member is further attached to an flexible member configured to affect rotation of the bridge, and a safety stop component disposed with in the body and configured to restrict movement of the vertical member. The soundboard is attached to the body via a side binding and unattached to internal support members within the body other than may be located at the outside edges of the soundboard and intersecting body or neck assembly.

Certain embodiments of the invention include a feature of adjusting sound board height, a spring rate of the sound board, an initial bridge rotation, and/or a bridge rate of rotation.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
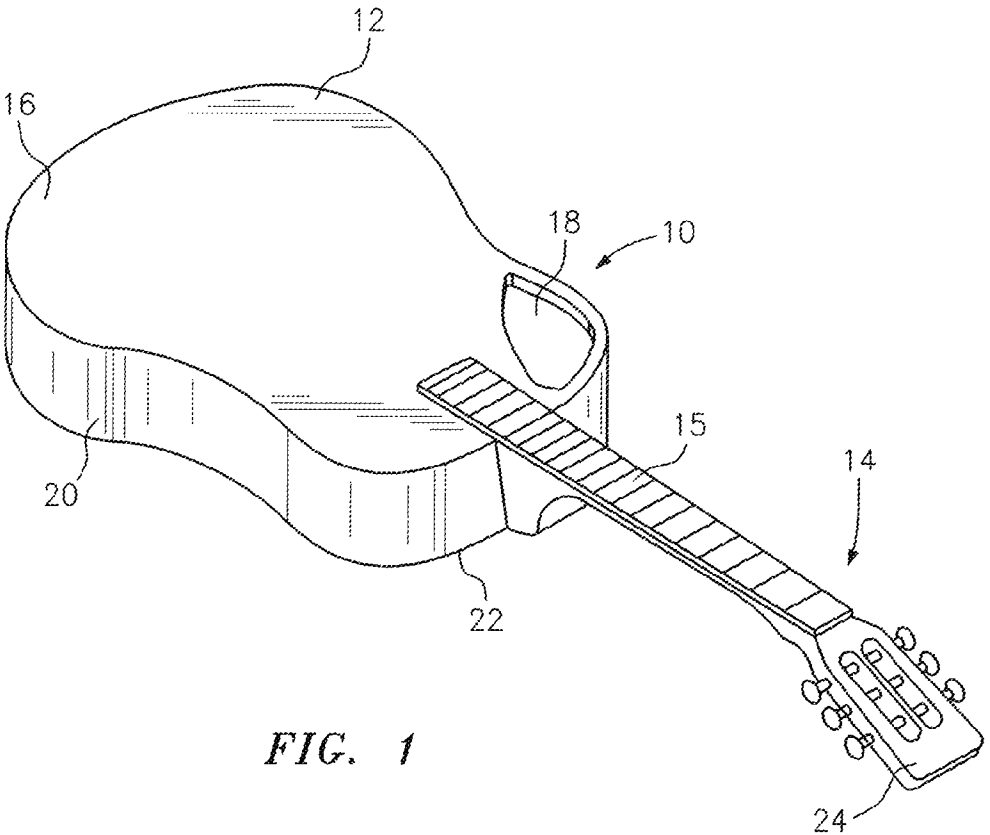
FIG. 1 illustrates an exemplary guitar having a neck and body including a soundboard with a soundhole, in accordance with the present disclosure.

Referring now to the drawings, wherein the depictions are for the purpose of illustrating certain exemplary embodiments only and not for the purpose of limiting the same, FIG. 1 shows an exemplary guitar 10 having a body 12 and a neck 14. The guitar body 12 has a soundboard 16 with a soundhole 18. The soundboard 16 is connected to sidewall 20, which in turn, is connected to a backboard 22. The neck 14 has a headstock 24 and a fingerboard 15 generally having frets. Strings (not shown) are strung from tuners located in the headstock 24, over a nut (not shown) and over the neck 14 and the fingerboard 15 to a bridge (not shown) holding the saddle (not shown) on the soundboard 16. For ease of description, an exemplary guitar will be shown and described herein, as one skilled in the art will readily appreciate, the teachings of the disclosure herein may readily be applied to various types of stringed instruments including guitars and therefore is not intended to be limited thereby.

Currently, stringed instruments are built with auxiliary bracing attached by glue or other means directly to a soundboard or by use of alternate soundboard material construction using composites, honeycomb reinforcement, laminated construction or extra thick wooden soundboards to counter internal physical forces to prevent failure of the soundboard. The normal bracing applied to a soundboard to brace against forces associated with string force other than tensile and compressive components must be built heavier than otherwise would be required. A thin e.g., one-tenth of an inch, single surface book matched wooden soundboard or other thin material construction may be constructed without use of traditional bracing by directly offsetting tensile and compressive forces, thus removing related moment. Therefore, the bracing applied to prevent failure of the soundboard 16 is substantially decreased.

Figure 2:
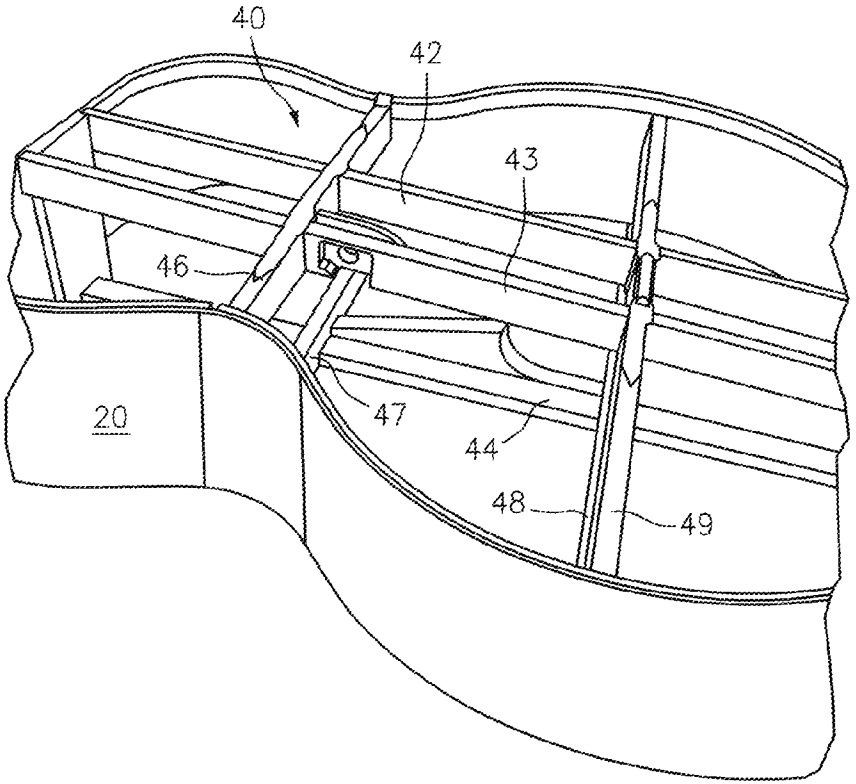
FIG. 2 is a perspective view of an exemplary internal support structure within the guitar, in accordance with the present disclosure.

FIG. 2 shows an exemplary internal support structure 40 within the guitar 10. The support structure 40 is attached to various points of the sidewall 20. In one embodiment, the support structure 40 includes longitudinal support members 42 and 43 positioned toward the soundboard 16, and a longitudinal support member 44 associated with the backboard 22. The support structure 40 further includes transverse members 46, 47, 48, and 49 configured to cross various longitudinal support members and attached to the sidewall 20 at various points. As FIG. 2 shows, top surfaces of the longitudinal support members 42 and 43 along with top surfaces of the transverse members 46 and 49 are preferably disposed at a depth below an undersurface of the soundboard. In this way, the top surfaces are not contacted by the soundboard 16, enabling the soundboard 16 to vibrate unimpeded by the support structure 40.

Figure 3A:
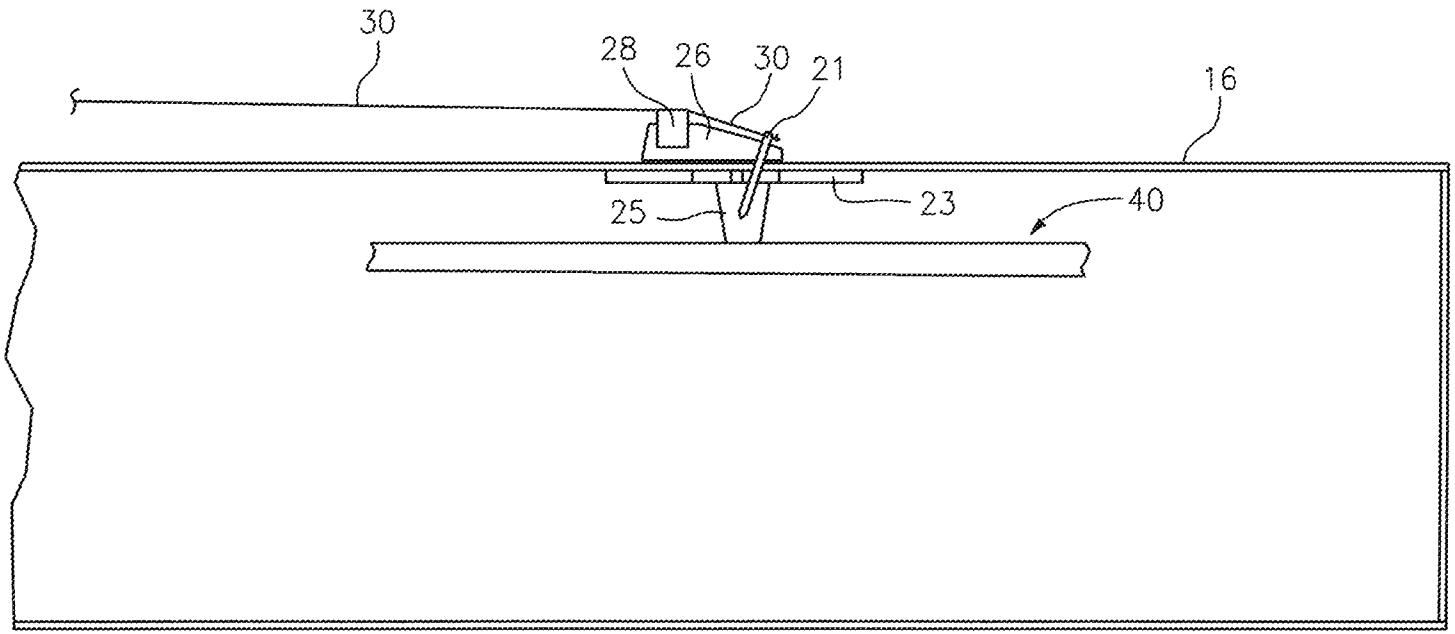
FIG. 3A shows a cross-sectional side view of the guitar illustrating a structural embodiment used to brace the soundboard, in accordance with the present disclosure.
Figure 7:
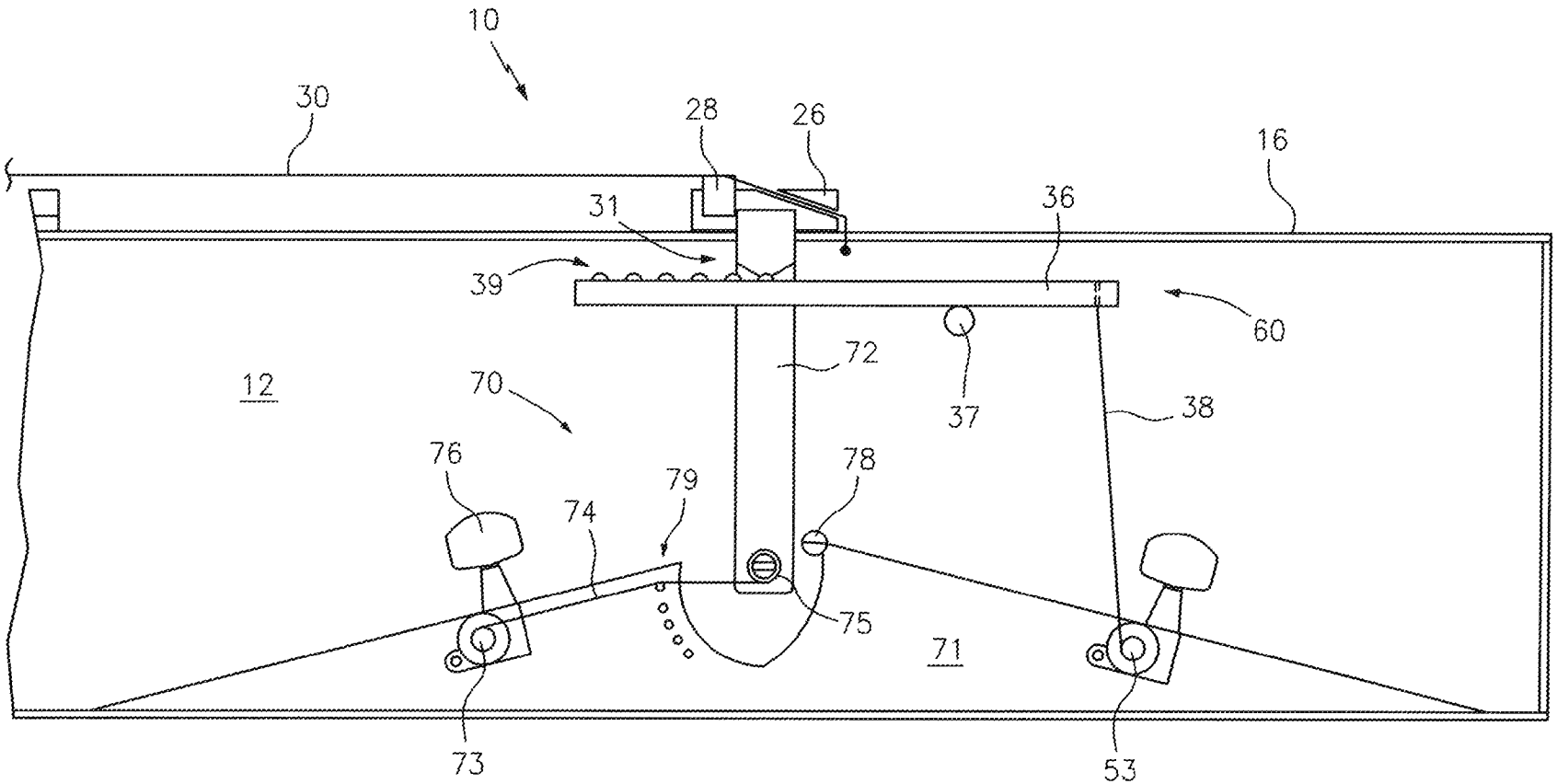
FIG. 7 is a cross-sectional side view of the guitar illustrating a further embodiment of the soundboard height adjustment control assembly and bridge rotational control assembly, in accordance with the present disclosure.

FIG. 3A shows a cross-sectional side view of the guitar 10 illustrating a structural embodiment used to brace the soundboard 16. As FIG. 3A shows, a plurality of instrument or guitar strings 30 are strung to a string support saddle 28 mounted on a bridge 26 to a string attachment pin 21. The bridge 26, including the string support saddle 28 mounted thereon, is configured to support the plurality of strings 30. In one embodiment, the strings 30 may be mounted through the soundboard 16 as shown in FIG. 7. In this configuration, the string attachment pin 21 are mounted to the bridge 26 and positioned to pierce the soundboard 16 and be permanently anchored in an under soundboard mounted anchor point 25 so as to resist tearing of the bridge 26 from the soundboard 16, thereby offsetting shear and providing rigid attachment of the bridge 26 to the soundboard 16 for propagation of vibration (s) that produce sound. A contact support component 23 is attached to an underside of the soundboard 16. The contact support component 23 is preferably configured to brace the soundboard 16 against an internal support structure 40 via a reinforcement block 25. In one embodiment, the block 25 is height adjustable. In one embodiment, the block 25 is a spring.

Figure 4:
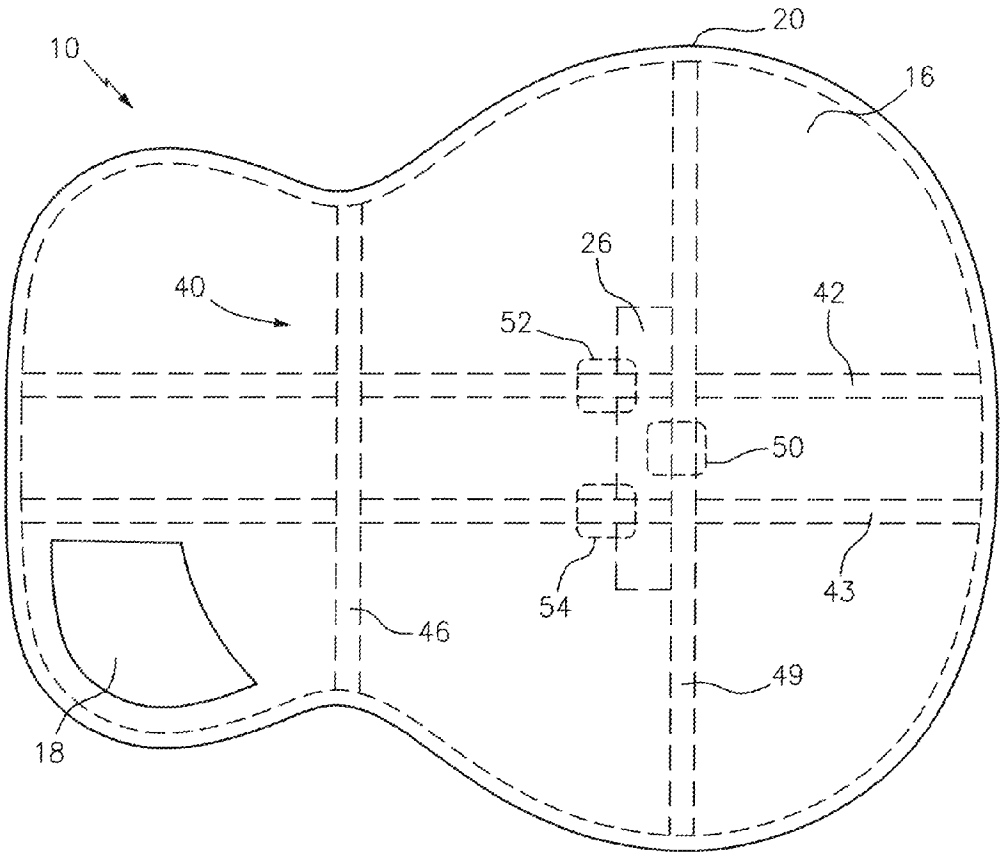
FIG. 4 shows a top view of the guitar illustrating the support structure arrangement within the guitar body and exemplary contact support areas engaged to an underside of the soundboard, in accordance with the present disclosure.

The spring may be disposed between the underside of the soundboard 16 and the transverse member 49 as shown in FIG. 2. The spring is preferably disposed proximate to the bridge 26 as described herein above such as via contact area 50 as shown in FIG. 4 on exemplary support structure 40. However, in one embodiment, the position of the spring along a support member such as the transverse member 49 shown in FIG. 2 may be adjusted so that the spring contacts a different position on the underside of the soundboard 16. By adjusting the length of a spring that engages the soundboard 16, changing the size or material type used in the construction of the spring, or other method so as to change the physical property of the spring device to resist or yield to forces acting upon it, initial spring height and rate of spring resistance can be affected directly impacting amplitude, excursion and rate of excursion of the soundboard 16. Thus playability can be adjusted as relating to initial string height over fingerboard and excursion of string over the fingerboard due to a musician's style of play. A musician that inputs more energy to the string will require more control over excursion than will a light handed player. String radius of gyration will be greater for the heavy handed musician than the light handed musician and will require greater control over ultimate radius of string gyration to in order to avoid interference with the fingerboard.

The spring may be affixed to the underside of the soundboard 16 using an adhesive or mechanically attached using means known in the art. In one embodiment, the underside of the soundboard 16 by be recessed and adapted to receive an end of the spring. In one embodiment, an adjustable lever is engaged with a second end of the spring. The lever may be adjusted by applying a force from a flexible member via turnbuckle, guitar tuner or other mechanical tension adjustment device. In one embodiment, the lever is replaced with a shim. The shim may be affixed to the support structure under a side of the spring or installed in a captive position. In a further embodiment, a lever and/or the shim are directly engaged to the underside of the soundboard.

Figure 3B:
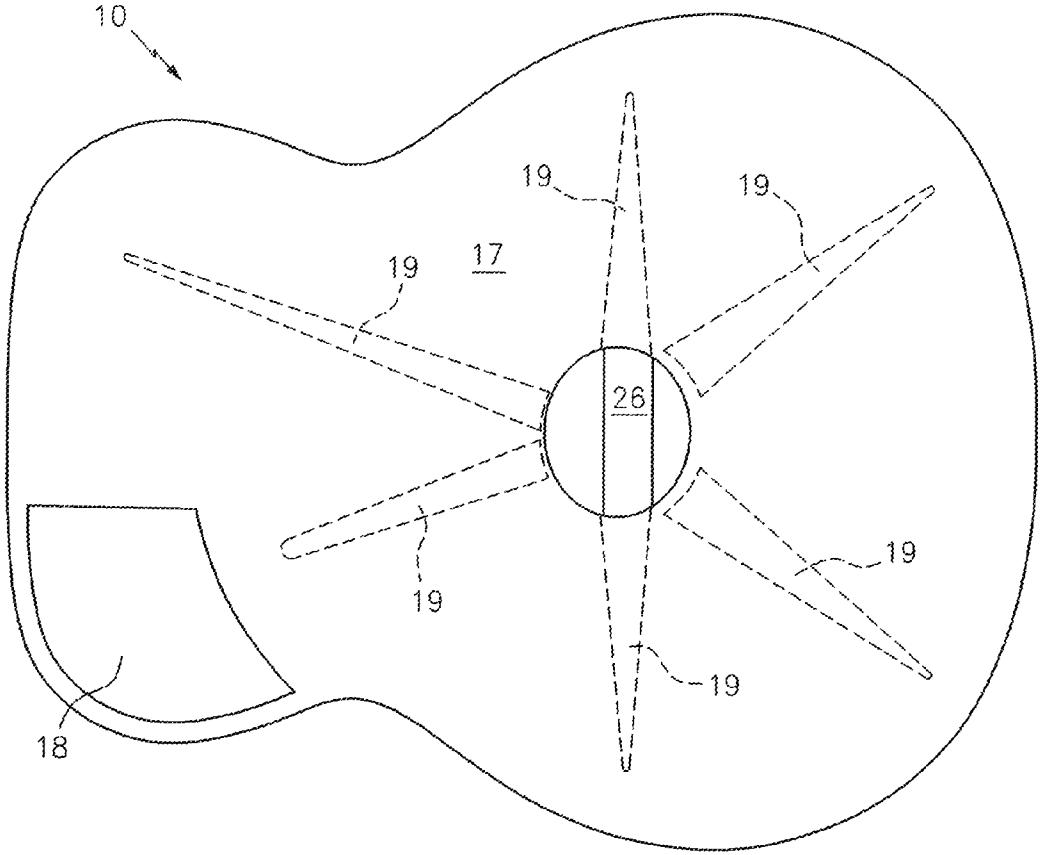
FIG. 3B shows an underside of an exemplary soundboard of the guitar, in accordance with the present disclosure.

FIG. 3B shows an underside 17 of an exemplary soundboard 16 of the guitar 10. As FIG. 3B shows, bracing 19 may be coupled to the underside 17. In one embodiment, the bracing 19 is between 3/16 and 1/8 of an inch in width. The bracing is positioned to tie cross-grain of the soundboard 16 together to prevent tear out or tears between wood grain and to add some harmonic control, i.e., by acting as a "diaphragm" such as in a speaker to propagate vibrations outward. Additionally, the bracing 19 may be configured and positioned to prevent the inline shear to tear out the soundboard 16 and/or bridge 26 as a through board connection of string ends may rip through soundboard 16 if not reinforced over the string anchor area and those forces spread out over the cross-grain.

The soundboard 16 requires bracing only be applied so as to counter the tensile and compressive forces, therefore, the applied soundboard bracing is a minimum amount deemed necessary, in cross section and mass to prevent: plastic deformation and creep of the soundboard surface due to inline tension, "fluttering" or uncontrolled physical vibration of the soundboard 16, and tearing of the bridge from the surface of the soundboard 16 due to shear. Plastic deformation and creep of the soundboard surface due to inline tension is generally dependent upon soundboard physical material properties, and area string force is applied as related to the physical attachment patch of the bridge (more area spreads forces over more fiber or material surface and cross section), and an attachment point of strings themselves such as if attached as an integral part of the bridge itself or alternately anchored such as under board to alternate member or a tailpiece arrangement such as present in a traditional arch top guitar.

Uncontrolled physical vibration of the soundboard 16 is generally dependent upon soundboard rigidity, construction, and cross section. In thin or weak soundboard embodiments, the soundboard may resonate uncontrollably, i.e., flutter, and/or be prone to the creation of constructive or destructive harmonics and/or standing waves within body dependent upon fundamental frequencies. As described herein below, controlling a soundboard spring rate can resolve these issues by increasing the spring rate until sufficient damping is achieved to control the soundboard movement.

Tearing of the bridge from the surface of the soundboard due to shear is generally dependent upon construction of the contact points of the bridge to the soundboard. Traditionally, the bridge is glued to a surface of the soundboard and a physical area or patch must be considered per the material properties of the soundboard and bridge—more area spreads the forces over more fiber or material. Tearing can be minimized using supplemental components through the soundboard attachment to an under soundboard patch or other modified attachment method that will increase the area of/and or integrity of the attachment through other means. In embodiments using alternate string anchoring, e.g., a tailpiece of a traditional arch top guitar, tearing is not an issue and in fact the bridge is free floating and need not be permanently attached to the soundboard such as in a traditional acoustic guitar.

FIG. 4 shows a top view of the guitar 10 illustrating the support structure arrangement within the body 12 and exemplary contact support areas engaged to an underside of the soundboard 16. As FIG. 4 shows, the soundboard 16 is engaged to the support structure 40 via one or more contact areas 50, 52, and 54. Preferably, the contact areas are engaged by the contact support component 23 as described and illustrated with reference to FIG. 3. In this way, the spring may be adjusted, such as a height, raising a soundboard height and therefore raising height of the strings off of the fret or fingerboard 15 of the neck 14.

Figure 5A:
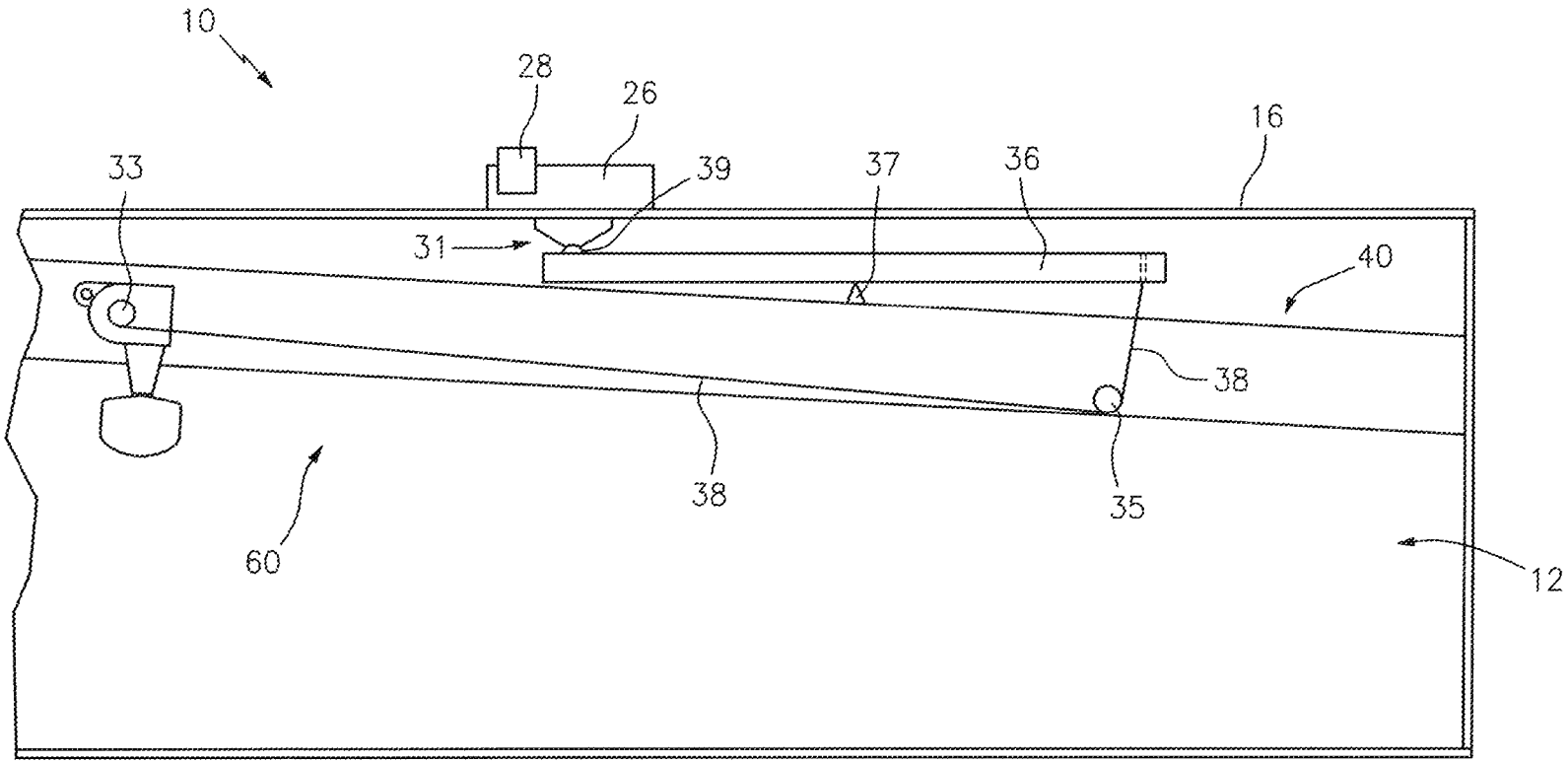
FIG. 5A shows a cross-sectional side view of the guitar illustrating a soundboard height adjustment control assembly, in accordance with the present disclosure.

FIG. 5A shows a cross-sectional side view of the guitar 10 illustrating a soundboard height adjustment control 60 used to brace and control height of the soundboard 16. As FIG. 5A shows, the soundboard height adjustment control 60 includes a mechanical component 31, an anchor 33, an alignment bar 35, an adjustable member 36, and a lever 37. The adjustable member 36 is preferably attached to a second anchor 33 via a flexible member 38. The flexible member 38 may be, e.g., any known wire or cable type configured to connect the anchor 33 to the adjustable member 36 via the alignment bar 35. The anchor 33 is rigidly attached to a support structure 40 within the body 12. The alignment bar 35 is configured to direct tension associated with the anchor 33 to the flexible member 38 and to the adjustable member 36. The anchor 33 is preferably a mechanical tension adjustment device such as a guitar tuner component configured to receive and secure the strings or flexible members for subsequent tension adjustment.

The mechanical component 31 is configured to direct pressure from the adjustment member 36 to the underside of the soundboard 16. In one embodiment, the mechanical component 31 may include a compression pad or patch secured to the underside of the soundboard 16 and a spring device. The spring device may be any type of flexible pressure or dampener such as a string path device, roller, dowel, or spring lever configured to apply pressure or remove pressure from the underside of the soundboard 16. The mechanical component 31 is connected to the adjustable member 36 via a fastener 39 such as a physical captive attachment device.

The soundboard height adjustment control 60 is configured to adjust pressure applied to the underside of the soundboard 16 by adjusting pressure of the adjustable member 36 against the mechanical component 31. For example, increasing tension in the flexible member 38 using the anchor 33 pulls an end of the adjustable member 36 in a downward direction while pushing another end in an upward direction via the lever 37.

Figure 5B:
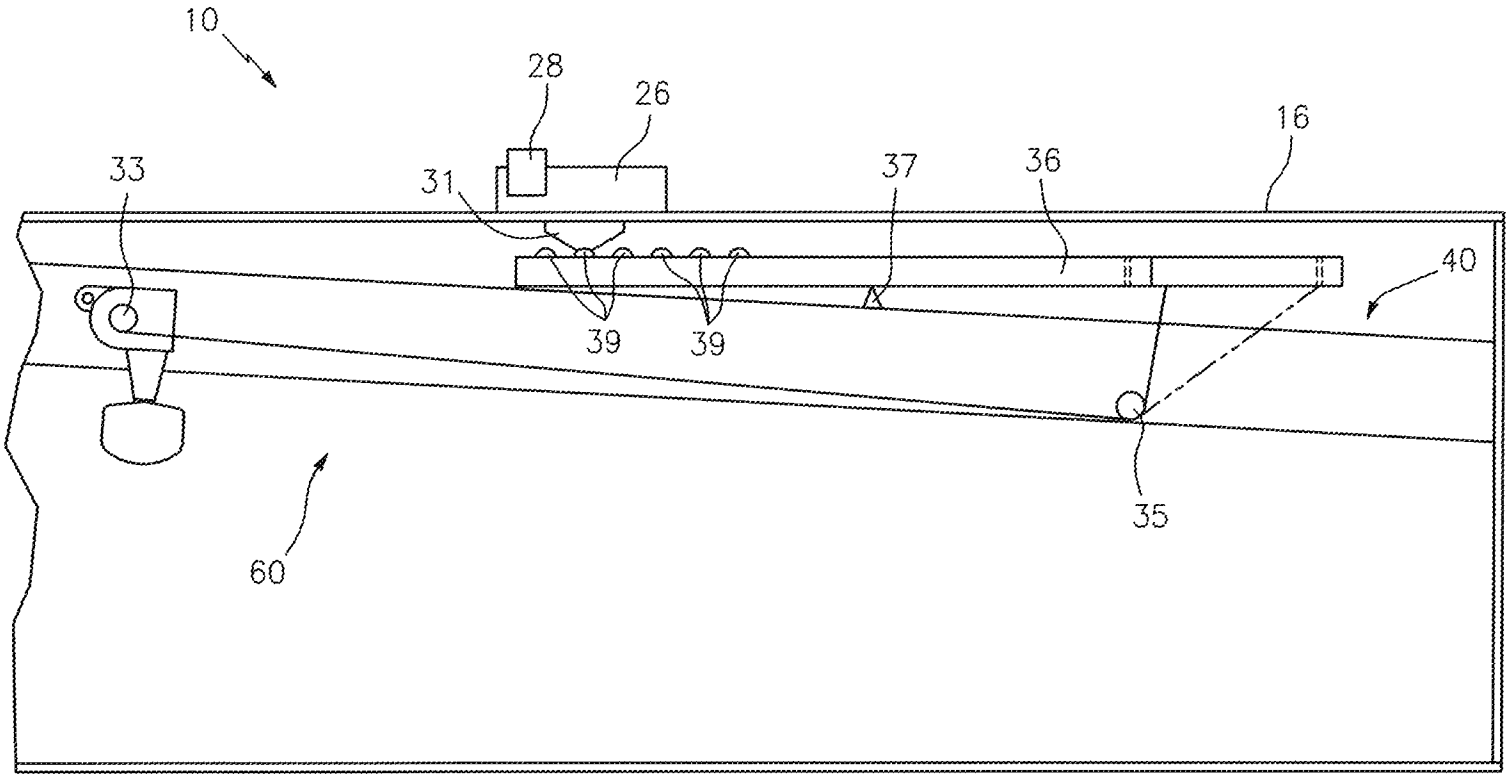
FIG. 5B shows a cross-sectional side view of the guitar illustrating an adjustable embodiment of the soundboard height control assembly, in accordance with the present disclosure.

FIG. 5B shows a cross-sectional side view of the guitar 10 illustrating an adjustable embodiment of the soundboard height control assembly 60 used to brace and control height of the soundboard 16. As FIG. 5B shows, a plurality of fasteners 39 may be disposed on the adjustable member 36. The plurality of fasteners 39 enables a user to control a radius of gyration of excited strings in relation to interference with the fingerboard by changing a spring rate of the soundboard 16 to accommodate a musician's style of play or preference. The adjustment capability allows for more granular control of the phenomenon known as string buzz over the frets as string height can be maintained and modified over a broader area of the fingerboard. The benefit is that the musician can adjust the instrument for preferential action i.e., keeping the action well defined within a range based on their individual playing style. By selectively attaching the mechanical component 31 to a selected fastener 39 on the adjustable member 36, the user controls spring rate dampening of amplitude or excursion of the soundboard 16.

In one embodiment, the mechanical component 31 includes a spring configured to control the spring rate of the soundboard 16. The spring may be installed or applied as a constant spring rate device dependent on the device's construction and material properties. Modification would require replacement of the spring with a stiffer or more flexible one, change in the lever position or anchor point of the spring such as via the plurality of fasteners 39, material removal or addition—such as a carved wood material removal or glued addition, as a sliding spring that can be shortened or lengthen over its active length. The spring may be adjusted through use of a turnbuckle, shim, guitar tuner or other method if the spring is able to be moved to change its lever point, effective length or rate. The spring itself may be made with a varying cross section which when moved along the lever point causes changes to rate by changes to varying cross section stiffness. Additionally, a shim may be used to adjust the lever point, change the anchor point along the spring, and/or add or reduce an effective length of the adjustable member 36.

Figure 6A:
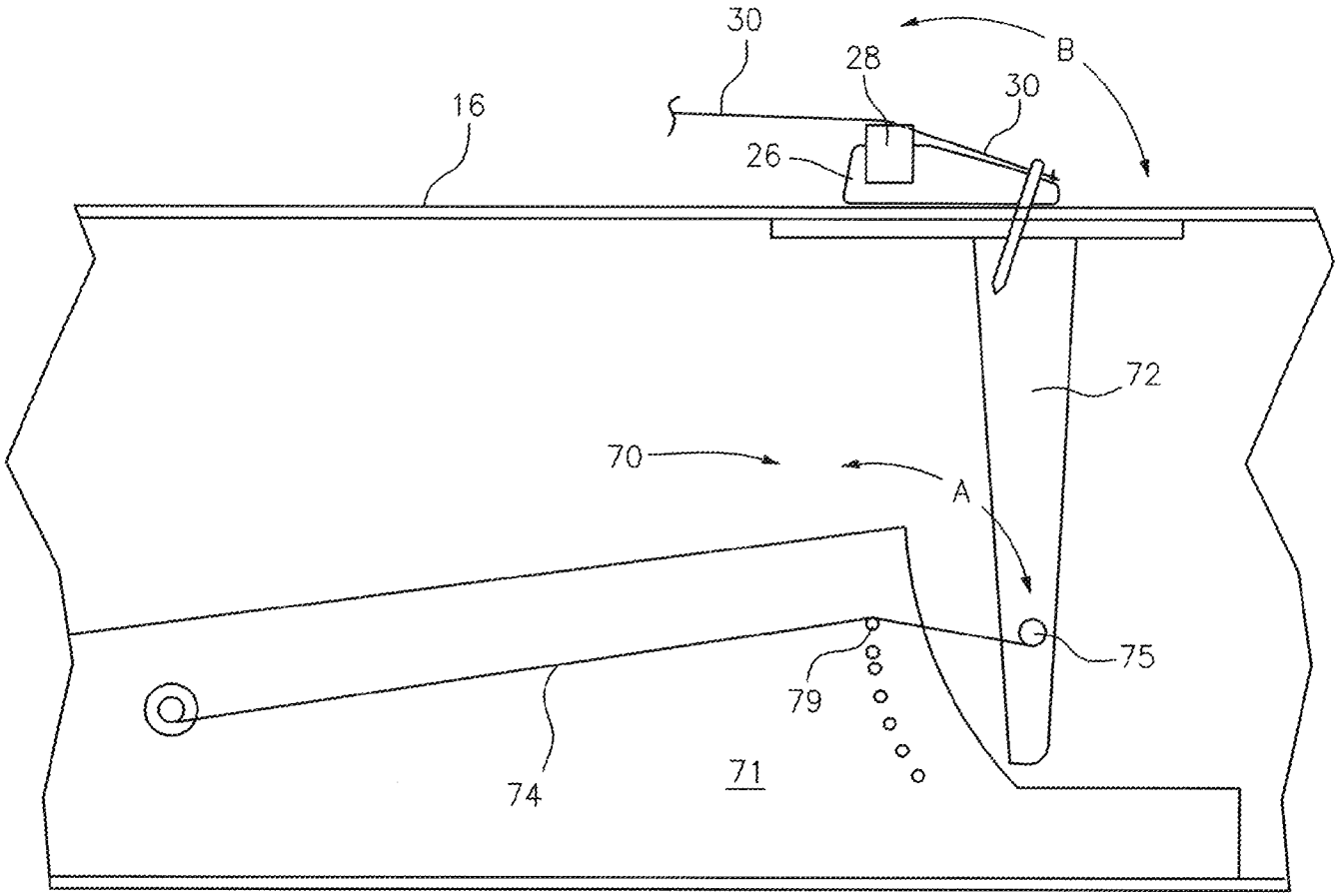
FIG. 6A shows a cross-sectional side view of the guitar illustrating a bridge rotational control assembly, in accordance with the present disclosure.

FIG. 6A shows a cross-sectional side view of the guitar 10 illustrating a bridge rotational control assembly 70. The bridge rotational control assembly 70 includes a member 72 including a mechanical attachment component 75, a support structure 71, an anchor 73, a flexible member 74, and a tuner 76. The flexible member 74 connects the tuner 76 to the member 72 via the anchor 73 and the mechanical attachment component 75. The tuner is configured to adjust tension and length of the flexible member 74 between the anchor 73 and the mechanical attachment component 75. The member 72 is attached to the bridge 26 through apertures in the soundboard 16. The member 72 is configured to pivot about pin 79 whereat the flexible member 74 is fastened. In this way, the member 72 rotates about the rotational direction A shown in FIG. 6A. Forces of the strings 30 and the bridge rotational control assembly 70 cause the bridge 26 to incur rotational forces along a direction B as shown in FIG. 6A.

Figure 6B:
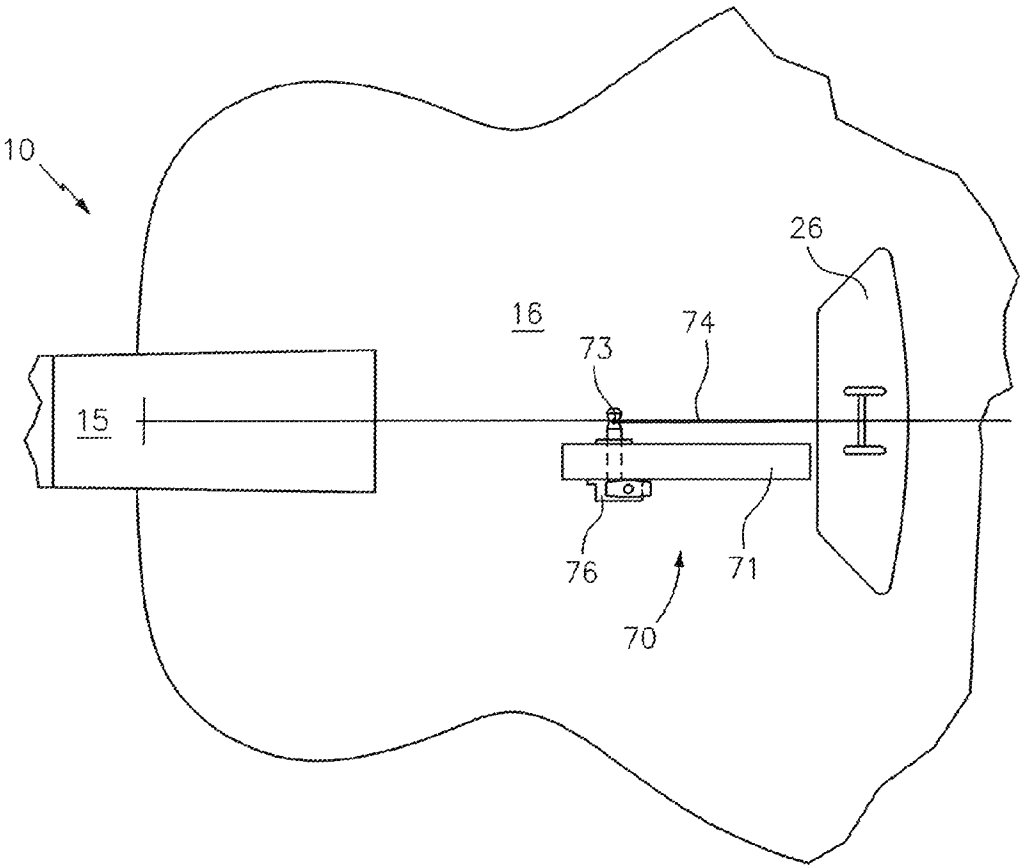
FIG. 6B shows a top view of the guitar illustrating an arrangement of the bridge rotational control assembly, in accordance with the present disclosure.

FIG. 6B shows a top view of the guitar 10 illustrating an arrangement of the bridge rotational control assembly 70. As FIG. 6B shows, the bridge rotational control assembly 70 is preferentially aligned with an anchor point 73 forward within the instrument in a straight-line and directly attached to the bridge 26 via a bridge plate extension arm, i.e., the member 72. A transverse or other device orientation may be used. A straight-line arrangement permits for use of the least material in construction as only straight-line forces need to be countered.

The bridge rotational control assembly 70 counters rotational force, i.e., moment, imparted by the strings 30 upon the bridge 26. In embodiments of the guitar 10 that utilize alternate string anchor points such as an arch top guitar, an initial rotation of the bridge 26 is not present but can present itself once a string is plucked which causes the string to drag the saddle 28. Saddle drag then causes the bridge 26 to rotate; thus affecting note reproduction due to changes in string saddle to nut/fret distances. Additionally, stringing the instrument and adjusting string initial tension may cause some initial rotation of the bridge 26 due to these same considerations. The bridge rotational control assembly 70 enables a user to adjust the tuner 76 to adjust for string weights and string distances. In one embodiment, a turnbuckle or other adjustment mechanism configured to control bridge rotation by means of a member or string may be used in place of the tuner 76 and flexible member 74.

By way of example, adjustment of the bridge rotation allows for control over changes related to "intonation" due to string weight changes, instrument aging issues, humidity, temperature and most other common issues. String aging e.g., yielding and stretching over time due to tension, can be affected by increasing string tension to proper tune due to loss of cross section in conjunction with slight adjustment of bridge initial rotation or re-intonation to the changed string. In other scenarios, saddle placement for a given scale length can be adjusted yielding proper instrument tune.

Since the bridge rotational control assembly 70 device controls rotational forces at the bridge 26 and sets initial rotation less bracing under the soundboard 16 is required since there is no longer a rotational component present. These forces can be substantial in many soundboard embodiments and are difficult to control by a wooden soundboard without increasing thickness which would add mass—thus changing sound of the soundboard. Removing the rotational force from the soundboard permits a preferential audio output of the instrument.

Further, the bridge rotational control assembly 70 counters the bridge moment forces impacting the soundboard in a traditional instrument and therefore the soundboard will not have the tendency to deform either non-plastically or plastically over time due to rotational forces. Deformation in a traditional instrument may appear as a dip in front of the bridge and a "pucker" or upward soundboard ripple behind the bridge.

By altering the angle of flexible member 74 between parallel to the soundboard 16 to less or greater than parallel allows more or less rotation of the bridge 26 and therefore affects rippling across the soundboard 16. The rippling causes changes in instrument tune as the bridge 26 is allowed to rotate in response to tension of the strings 30, additionally affecting production of harmonic components and creating a loss of energy that would otherwise be directly used to drive the soundboard 16 up and down in primary sound production. If the bridge rotation is negated entirely then the soundboard 16 is forced to move up and down only in reaction to string fretting and plucking, resulting in an increase in sound production.

Figure 6C:
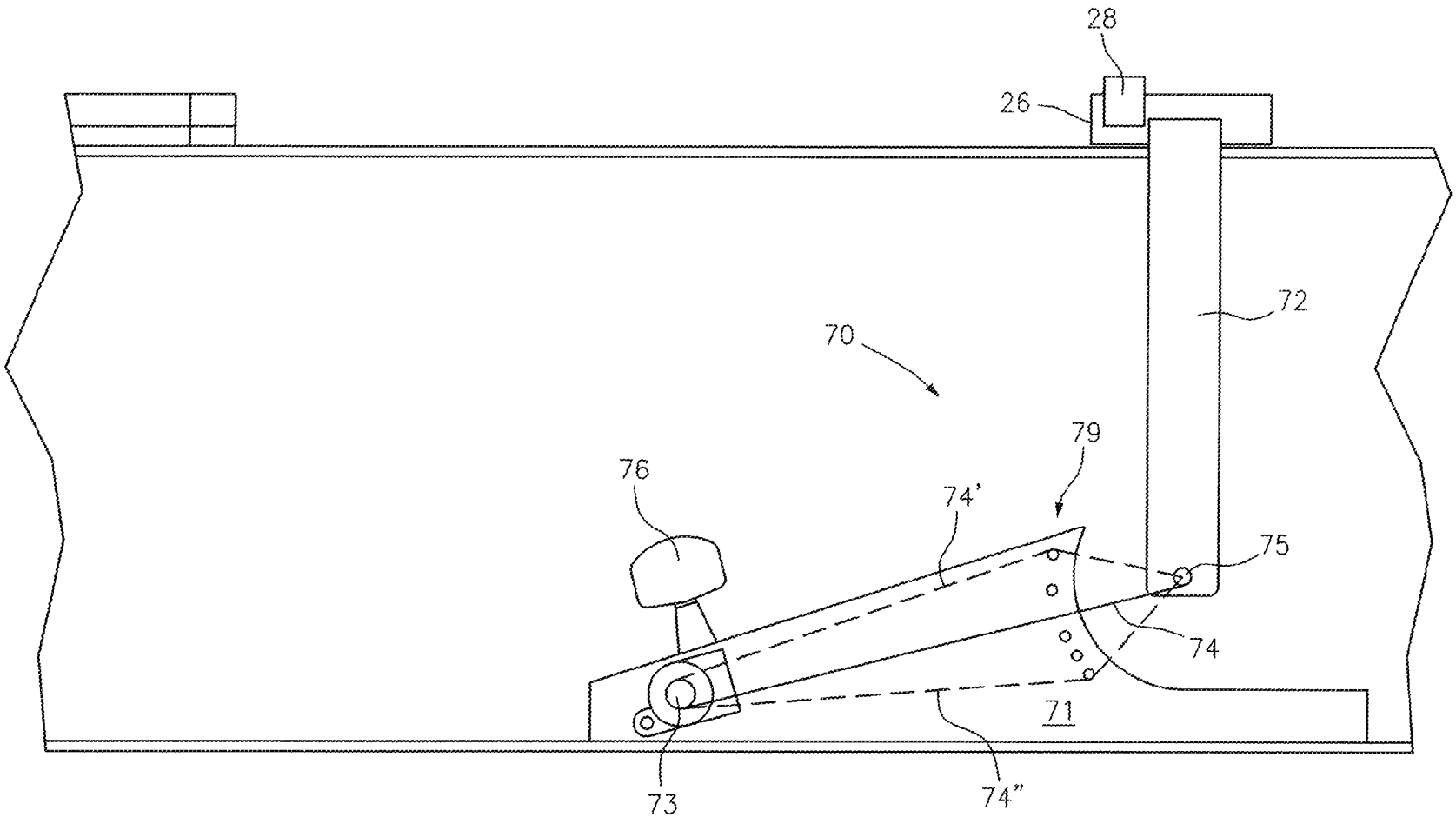
FIG. 6C shows a cross-sectional side view of the guitar illustrating a plurality of pins of the bridge rotational control assembly, in accordance with the present disclosure.

FIG. 6C shows a cross-sectional side view of the guitar 10 illustrating a plurality of pins 77 of the bridge rotational control assembly 70. As FIG. 6C shows, the pins 77 are attached to the support structure 71 and configured to direct the flexible member 74 to the attachment component 75 of the member 72. Pin positions on the support structure 71 affect rates of rotation of the bridge 26 via the member 72 and flexible member 74. By providing more than one bridge rotation rate option to a user, a string instrument may be allow many different styles of sound. For example, the guitar 10 may be configured to produce more or less harmonics and clear or distorted sound, depending on pin position used by the user. This device works by changing the angle from the forward anchor point of the device to the bridge anchor. The radius the bridge is free to rotate over during it's up and down movement can be varied.

Rotation rate of the bridge 26 affects harmonics and pitch production when playing a string. Selectable pins enable a user to control variation of bridge rotation within a set limit and therefore providing granular control of harmonics and pitch change. For example, attaching anchor 73 to the attachment component 75 via the flexible member 74' as directed by a bottom position pin 77 may produce a harmonic associated with a "bluegrass" sound, while the flexible member 74" as directed by a top position pin 77 may produce more of a pure tone similar to a piano sound. By providing a plurality of pin positions, a user can control an amplitude or magnitude of each component sound, enhancing or muting primary frequency or harmonic frequencies as they relate to overall sound generation. Therefore, allowing or limiting the "rippling" across a soundboard can also assist in maximizing coherent waves forms, and assist in controlling nodal and non-nodal frequency collisions which may appear as "wolf tones" or "reduced sound volume of a frequency" i.e., additive amplitude waveforms or cancelling waveforms.

In one embodiment, the bridge rotational control assembly 70 may include an adjuster to incorporate a slight plus and minus variable from center position. Controlling position provides a variable bridge string length after a string is plucked producing a "tremelo" sound in a guitar instrument embodiment.

Figure 6D:
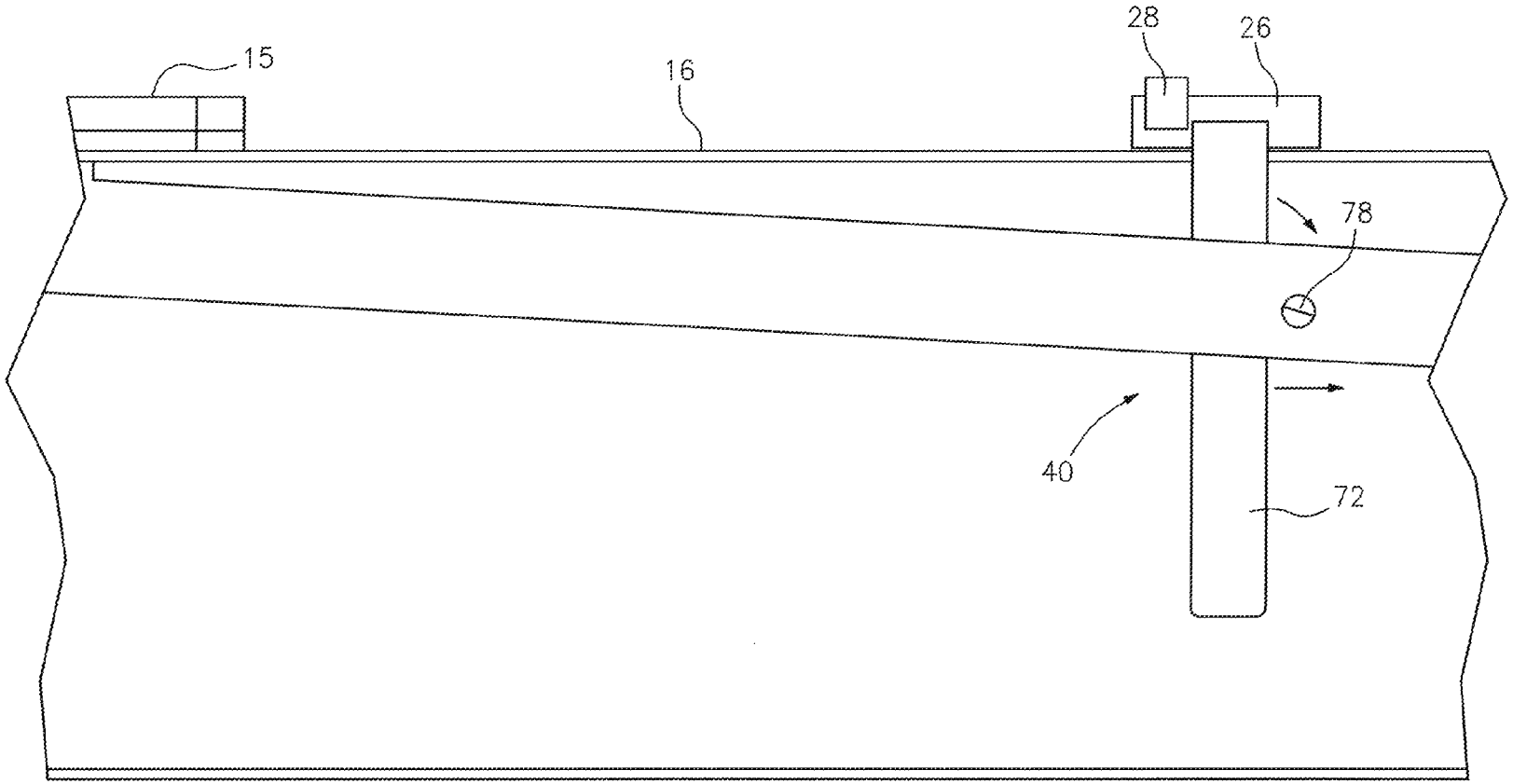
FIG. 6D shows a cross-sectional side view of the guitar illustrating a safety stop component, in accordance with the present disclosure.

FIG. 6D shows a cross-sectional side view of the guitar 10 illustrating a safety stop component 78. As FIG. 6D shows, the safety stop component 78 is attached to the support structure 40. The safety stop component 78 is a failsafe stop to limit bridge rotation in the event of a broken bridge rotations device. The safety stop component may be a dowel, bar, or backstop configured to restrict movement of the member 72. This will prevent destruction of the soundboard 16 due to rotational forces that would otherwise not be contained due to the support structure 40 attachment or nonattachment from the soundboard 16. Additionally, the safety stop component 78 provides a "safe stop" so that the rotational adjuster can be repositioned or refitted without the need to unstring or remove string tension for changes to be made dependent on how the devices are implemented in a particular stringed instrument embodiment.

Figure 6E:
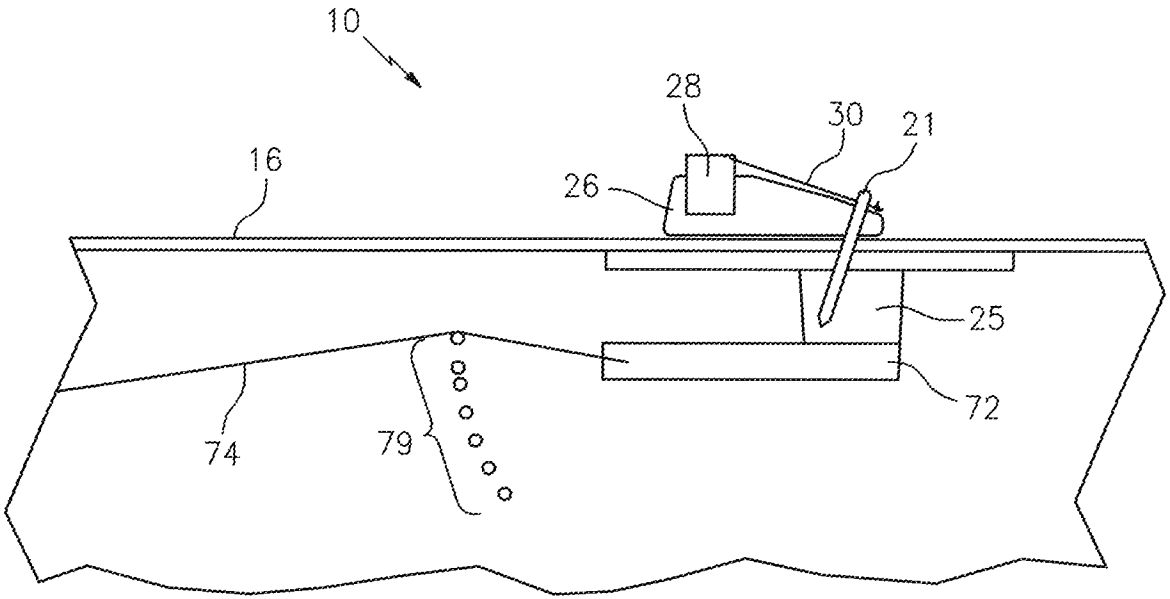
FIG. 6E shows a cross-sectional side view of the guitar illustrating a member of the bridge rotational control assembly, in accordance with the present disclosure.

FIG. 6E is a cross-sectional side view of the guitar 10 illustrating an exemplary embodiment of the member 72 described herein above. The member 72 may be vertically oriented as shown in FIG. 6A or horizontal as shown in FIG. 6E. In one embodiment, the member 72 is angled. In one embodiment, the member 72 is attached directly to the under soundboard mounted anchor point 25 or reinforcement patch. The member 72 is preferably positioned through the soundboard 16; however the member 72 may be connected to other components positioned through the soundboard 16.

FIG. 7 is a cross-sectional side view of the guitar 10 illustrating a further embodiment of the soundboard height adjustment control assembly 60 and bridge rotational control assembly 70. As FIG. 7 shows, the anchor 33 may be positioned without an alignment bar within the guitar body 12. As one skilled in the art will readily recognize, the anchor 33 may be positioned in many positions within the guitar body 12 and therefore is not intended to be limited to the positions shown in the illustrations. FIG. 7 additionally illustrates an alternative position for the safety stop component 78 with respect to FIG. 5D. As one skilled in the art will readily recognize, the safety stop component 78 may be positioned in many positions within the guitar body 12 to prevent undesirable movement of the member 72 and therefore is not intended to be limited to the positions shown in the illustrations.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A stringed musical instrument, comprising:

a body having a soundboard with a soundhole formed through the soundboard;

internal support members within the body;

wherein the soundboard is attached to the body via a side binding and unattached to the internal support members within the body;

a bridge, including a string support saddle mounted thereon, for supporting a plurality of instrument strings;

a member disposed vertically, normal to the plane of the soundboard, within the body attached to the bridge through apertures in the soundboard, wherein the member is further attached to a flexible member configured to affect rotation of the bridge by moving the member; and a safety stop component disposed within the body and configured to restrict movement of the vertical member.

2. The stringed musical instrument of claim 1, further comprising:

a soundboard height adjustment control that includes a moveable support member located within the body on which is mounted a mechanical component that is engaged to an undersurface of the soundboard.

3. The stringed musical instrument of claim 2, further comprising:

a plurality of pins are disposed on an internal support member and each pin is configured to direct the flexible member to the member attached to the bridge at a different approach angle.

4. The stringed musical instrument of claim 2, wherein the moveable support member is further configured for horizontal movement within the body, the horizontal movement changing a position of the mechanical component engaged to the undersurface of the soundboard.

5. The stringed musical instrument of claim 4, further comprising:

a second flexible member attached to a mechanical component configured to adjust tensionally engaged length of the second flexible member, the second flexible member directed to an end of the moveable support member at an angle configured to communicate a substantially horizontal force.

6. The stringed musical instrument of claim 5, wherein the mechanical component is a tuner.

7. The stringed musical instrument of claim 4, further comprising:

a plurality of pins each configured to direct the flexible member to the member, wherein the pins are disposed on an internal support member and each configured to direct the flexible member to the member at different approach angles.

8. The stringed musical instrument of claim 2, wherein the moveable support member is a pivoted horizontal brace having the mechanical component disposed on a first end and having a second end that is downwardly moveable.

9. The stringed musical instrument of claim 8, wherein the second end is downwardly moveable via a second flexible member.

10. The stringed musical instrument of claim 8, wherein the second end is downwardly moveable via a shim.

11. The stringed musical instrument of claim 1, further comprising:

a plurality of pins are disposed on an internal support member and each pin is configured to direct the flexible member to the member attached to the bridge at a different approach angle.

12. The stringed musical instrument of claim 11, wherein the different approach angles are configured to selectively affect a rate of bridge rotation.

13. A stringed musical instrument, comprising:

a body having a soundboard with a soundhole formed through the soundboard, wherein the soundboard is attached to the body via a side binding and adjustably supported by an internal support member within the body;

a bridge, including a string support saddle mounted thereon, for supporting a plurality of instrument strings;

a vertical member, vertical being normal to the surfaces of the soundboard, disposed within the body attached to the bridge through apertures in the soundboard, wherein the vertical member is further attached to a flexible member configured to affect rotation of the bridge, wherein the flexible member is directed to the vertical member at selectable angles; and a safety stop component disposed within the body and configured to restrict movement of the vertical member.

14. The stringed musical instrument of claim 13, wherein the internal support member within the body comprises horizontal and vertical adjustment means.

15. The stringed musical instrument of claim 13, further comprising:

a spring mounted to a moveable support member within the body and engaged to an undersurface of the soundboard.

16. The stringed musical instrument of claim 13, further comprising:

a moveable support member configured for horizontal movement within the body, the moveable support member comprising a plurality of fasteners for selectively changing a spring rate of the soundboard.

17. The stringed musical instrument of claim 16, further comprising:

a plurality of dowels each configured to direct the flexible member to the vertical member, wherein the dowels are disposed on an internal support member and each configured to direct the flexible member to the vertical member at selectable approach angles.

18. A stringed musical instrument, comprising:

a body having a soundboard with a soundhole formed through the soundboard, wherein the soundboard is attached to the body via a side binding and adjustably supported by an internal support member within the body;

a bridge, including a string support saddle mounted thereon, for supporting a plurality of instrument strings;

a vertical, vertical being normal to the surfaces of the soundboard, member disposed within the body attached to the bridge through apertures in the soundboard, wherein the vertical member is further attached to a flexible member configured to affect rotation of the bridge, wherein the flexible member is directed to the vertical member at selectable angles; and a safety stop component disposed within the body and configured to restrict movement of the vertical member.

19. The stringed musical instrument of claim 18, wherein the internal support member is attached to a spring and a compression pad engaged to the underside of the soundboard.

20. The stringed musical instrument of claim 18, further comprising a first tuner configured to move the internal support member horizontally via a first flexible member and a second tuner configured to pivot the internal support member into or away from the underside of the soundboard via a second flexible member.

* * * * *